US005155879A

United States Patent [19]

Klüttermann et al.

[11] Patent Number: 5,155,879

[45] Date of Patent: Oct. 20, 1992

[54] APPARATUS FOR AUTOMATICALLY STARTING FORMATION OF SLIVER FROM A CARDED WEB

[75] Inventors: Jürgen Klüttermann, Mönchengladbach; Ferdinand Leifeld, Kempen; Paul Teichmann, Mönchengladbach, all of Fed. Rep. of Germany

[73] Assignee: Trützschler GmbH & Co. KG, Mönchengladbach, Fed. Rep. of Germany

[21] Appl. No.: 744,581

[22] Filed: Aug. 13, 1991

Related U.S. Application Data

[63] Continuation-in-part of Ser. No. 561,137, Aug. 1, 1990, Pat. No. 5,095,587.

[30] Foreign Application Priority Data

Aug. 7, 1989 [DE] Fed. Rep. of Germany ..... 3926071
May 26, 1990 [DE] Fed. Rep. of Germany ..... 4017064
Aug. 16, 1990 [DE] Fed. Rep. of Germany ..... 4025854

[51] Int. Cl.[5] ..... D01E 27/00; D01H 5/72

[52] U.S. Cl. ..... 19/150; 19/159 R

[58] Field of Search ..... 19/106 R, 150, 152, 19/153, 157, 159 R, 159 A

[56] References Cited

U.S. PATENT DOCUMENTS

| | | | |
|---|---|---|---|
| 3,083,416 | 4/1963 | Hashimoto | 19/159 R |
| 3,825,975 | 7/1974 | Staeheli | 19/150 |
| 3,840,942 | 10/1974 | Thomason, Jr. | 19/150 |
| 4,213,553 | 7/1980 | Leifeld | 19/106 R |
| 4,232,426 | 11/1980 | Beneke et al. | 19/106 R |
| 4,275,482 | 6/1981 | Leifeld | 19/150 |
| 4,372,010 | 2/1983 | Gauvain | 19/159 R |
| 4,404,711 | 9/1983 | Klüttermann | 19/106 R |
| 4,501,048 | 2/1985 | Varga | 19/106 R |
| 4,965,912 | 10/1990 | Klüttermann et al. | 19/159 R |
| 5,018,246 | 5/1991 | Leifeld | 19/150 |

FOREIGN PATENT DOCUMENTS

| | | | |
|---|---|---|---|
| 0141691 | 5/1985 | European Pat. Off. . | |
| 0252622 | 1/1988 | European Pat. Off. . | |
| 0314310 | 5/1989 | European Pat. Off. . | |
| 2624015 | 12/1976 | Fed. Rep. of Germany . | |
| 7708228 | 2/1980 | Fed. Rep. of Germany . | |
| 2931568 | 2/1981 | Fed. Rep. of Germany . | |
| 3036579 | 6/1982 | Fed. Rep. of Germany | 19/106 R |
| 4017064 | 2/1991 | Fed. Rep. of Germany . | |
| 6030048 | 7/1986 | Japan | 19/106 R |
| 2062920 | 3/1987 | Japan | 19/106 R |
| 641120 | 2/1984 | Switzerland . | |
| 563915 | 9/1944 | United Kingdom . | |
| 904939 | 9/1962 | United Kingdom . | |
| 1155598 | 6/1969 | United Kingdom | 19/150 |
| 1323915 | 7/1973 | United Kingdom . | |

*Primary Examiner*—Werner H. Schroeder
*Assistant Examiner*—Michael A. Neas
*Attorney, Agent, or Firm*—Spencer, Frank & Schneider

[57] ABSTRACT

An automatic startup device in a carding machine includes a roll assembly for discharging the fiber web; and a web transporting arrangement situated under the roll assembly for gathering and advancing the web. The web transporting arrangement is formed of two adjoining, driven endless belts which together define a gap through which the web is discharged downwardly. The two endless belts or portions thereof are simultaneously shiftable horizontally to cause the web discharge gap to assume first and second locations spaced horizontaly from one another. There is further provided a trumpet situated under the web gathering belts. The trumpet has separable parts between which the web is introduced from the web discharge gap. In a separated position the two trumpet parts are at a relatively large distance from one another, whereby the web is discharged by the trumpet in a substantially unaltered state and in a joined position the two trumpet parts are at a relatively small distance from one another, whereby the web is compressed and discharged by the trumpet as a sliver. The trumpet, or parts thereof are moveable horizontally, so that the trumpet inlet is situated substantially vertically underneath the shiftable discharge gap in both of its locations. There are further provided a web delivery arrangement which is underneath the trumpet outlet when the web discharge gap is in its first location and a calender roll pair which is underneath the trumpet outlet when the web discharge gap is in its second location.

9 Claims, 10 Drawing Sheets

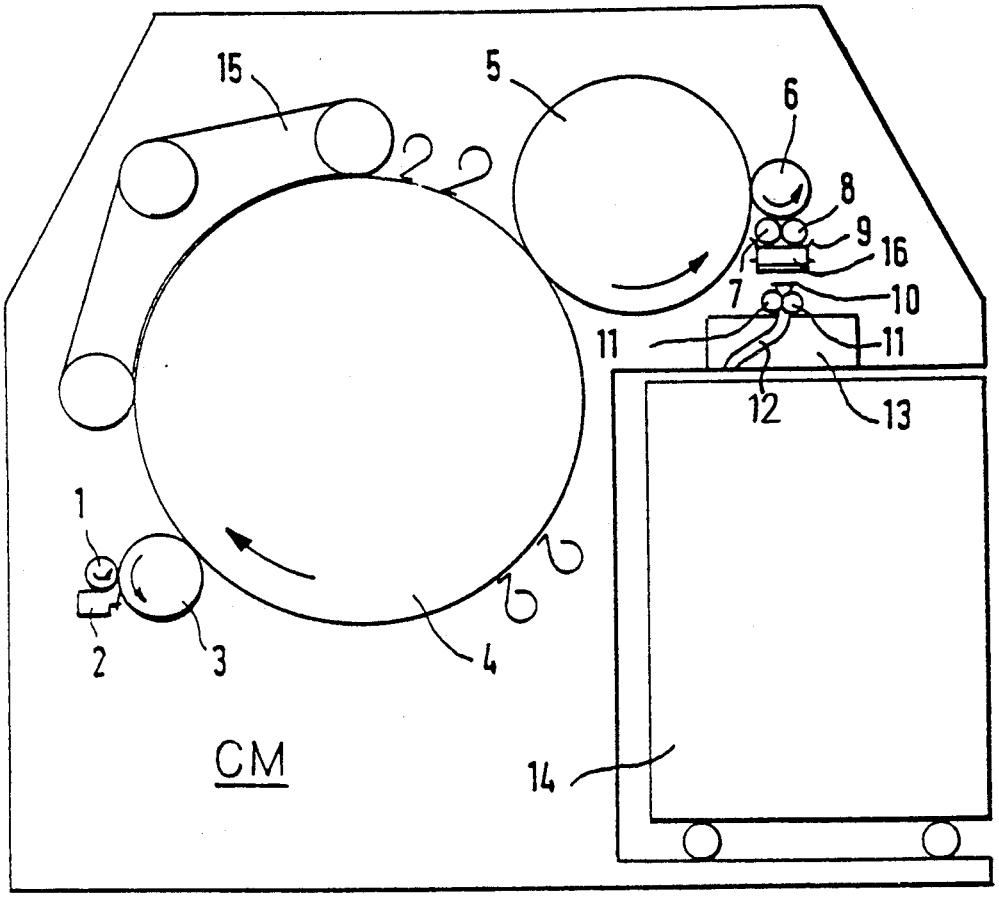
FIG.1
FIG. 1a
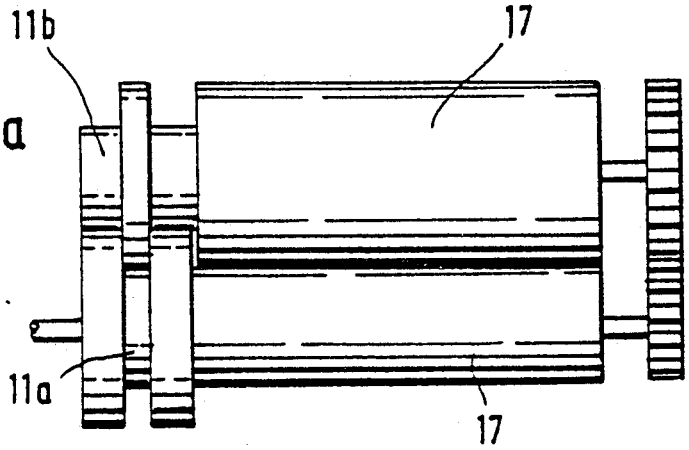

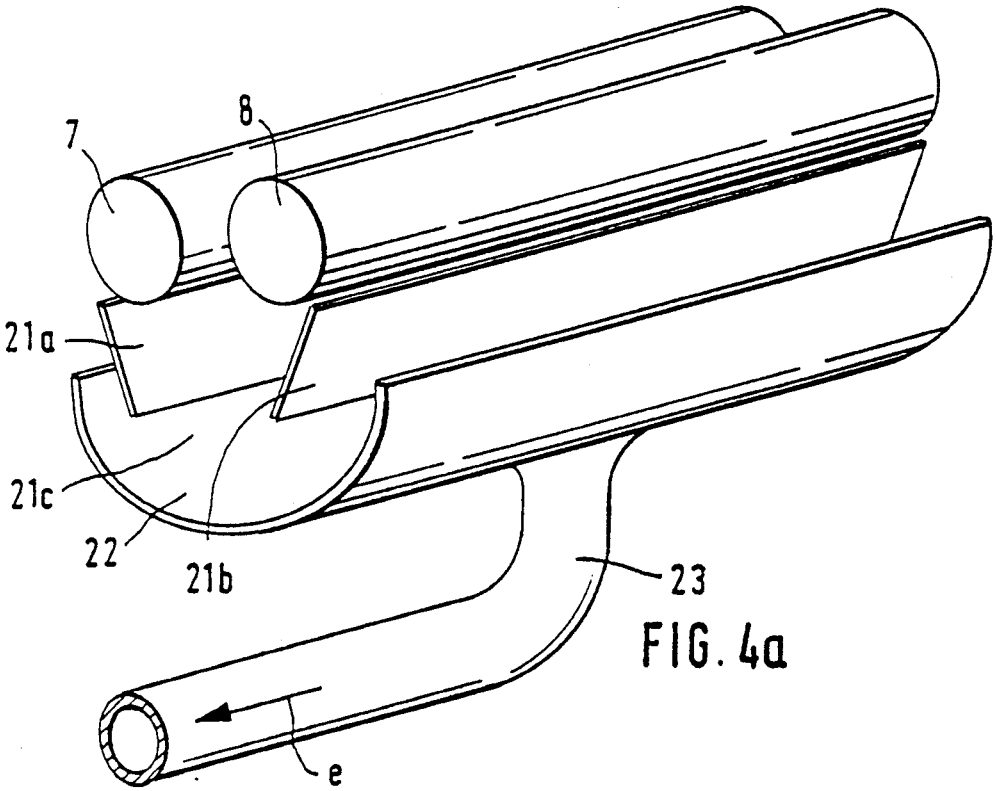
FIG. 4a
FIG. 4b
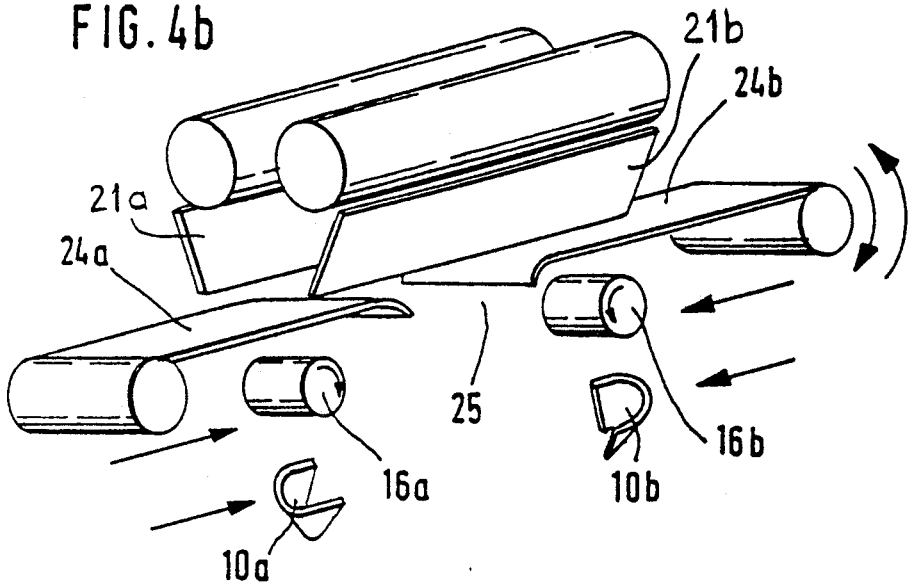

APPARATUS FOR AUTOMATICALLY STARTING FORMATION OF SLIVER FROM A CARDED WEB

CROSS REFERENCE TO RELATED APPLICATION

This application is a continuation-in-part of Ser. No. 07/561,137 filed Aug. 1, 1990 now U.S. Pat. No. 5,095,587.

This application claims the priority of Federal Republic of Germany Application Nos. P 39 26 071.2 filed Aug. 7, 1989, P 40 17 064.0 filed May 26, 1990 and P 40 25 854.8 filed Aug. 16, 1990, which are incorporated herein by reference.

BACKGROUND OF THE INVENTION

This invention relates to an apparatus for automatically grasping the leading end of a fiber web to start sliver formation therefrom. The apparatus is used, for example, in a carding machine in which the fiber web obtained from a roller assembly of the card is at least in part gathered and further advanced by a web transporting device, and in the starting phase the non-utilizable fiber web length is admitted to a web delivery device and is subsequently removed therefrom. In the thread-in phase the useful fiber web is surrounded by a trumpet and shaped into a sliver and further, the sliver discharged by the trumpet is advanced to a calender roll pair.

In practice, prior to the thread-in, the non-utilizable fiber web obtained, for example, from the crushing rolls is in a first step (starting phase) gathered by hand and thereafter torn off and removed. In a second phase (thread-in and production phases) the useful fiber web which is also discharged by the roll assembly of the card is gathered manually and thereafter, it is manually tapered and threaded through a trumpet into the gap formed by a calender roll pair which grasps the sliver and advances it to a sliver coiler which, in turn, deposits the sliver into a coiler can.

Published European Patent Application 314,310 discloses a method according to which the fiber web is gathered by two take-off belts and is compressed to a pre-sliver and further transported by two transfer or conveying rolls. During this phase of operation, a two-part segmented trumpet is in its open position so that the pre-sliver is not contacted by the trumpet. Also during this phase, the transfer rolls are driven with a first speed which is two to three times greater than the circumferential speed of the take-off belts, whereby a removal of fibers from the pre-sliver occurs. This results in a significant stretch of the fibers between the transporting rolls of the take-off belts and the transfer rolls, whereby the non-utilizable fiber parts of the pre-sliver are, in the starting phase, separated and removed.

The transfer rolls tear large tufts or clumps from the pre-sliver which fall into a suction pipe and are removed as waste. The tearing of fiber parts from the pre-sliver results in a generally tapered leading or threading end for the pre-sliver. The tapered pre-sliver terminus is introduced downwardly into the V-shaped structure of an air trumpet.

After completion of the starting phase (first step), the speed of the transfer rolls is reduced to a second, normal speed so that the circumferential speed thereof corresponds to that of the take-off belts. After the starting phase the thread-in procedure (second step) is effected upon introduction of the tapered pre-sliver into the air trumpet. From the air trumpet a tapered sliver emerges which, in turn, enters into the gap between a groove-and-feather roll pair and subsequently the sliver is deposited in the coiler can. As the carding machine has attained its normal production speed, in a third step the two parts of the segmented trumpet are brought together to thus place the trumpet in a closed position in order to surround the pre-sliver for preventing an expansion thereof over the surface of the transfer rolls. Stated differently, the segmented trumpet participates neither in the sliver formation nor in the tapering procedure of the fiber sliver.

It is a disadvantage of the above-outlined process that the terminus of the pre-sliver may rupture completely when large tufts or clumps are torn therefrom, causing the flow of fiber material to be interrupted, and thus an introduction of the pre-sliver into the fast-rotating transfer rolls cannot be effected in a satisfactory manner. Further, an undesired settling or clogging may occur. It is a further significant disadvantage of the above-outlined arrangement that the sliver formation is effected by pneumatic forces in the air trumpet. Such an arrangement is significantly complex and expensive and, particularly in case of errant air streams, leads to operational disturbances and consequently, a fully automatic thread-in is not possible.

SUMMARY OF THE INVENTION

It is an object of the invention to provide an improved apparatus of the above-outlined type from which the discussed disadvantages are eliminated and which, in particular, permits a reliable automatic startup in a simple and disturbance-free manner.

This object and others to become apparent as the specification progresses, are accomplished by the invention, according to which, briefly stated, the automatic startup device includes a roll assembly for discharging the fiber web; and a web transporting arrangement situated under the roll assembly for gathering and advancing the web. The web transporting arrangement is formed of two adjoining, driven endless belts which together define a gap through which the web is discharged downwardly. The two endless belts or portions thereof are simultaneously shiftable horizontally to cause the web discharge gap to assume first and second locations spaced horizontally from one another. There is further provided a trumpet situated under the web gathering belts. The trumpet has separable parts between which the web is introduced from the web discharge gap. In a separated position the two trumpet parts are at a relatively large distance from one another, whereby the web is discharged by the trumpet in a substantially unaltered state and in a joined position the two trumpet parts are at a relatively small distance from one another, whereby the web is compressed and discharged by the trumpet as a sliver. The trumpet, or parts thereof are moveable horizontally, so that the trumpet inlet is situated substantially vertically underneath the shiftable discharge gap in both of its locations. There are further provided a web delivery arrangement which is underneath the trumpet outlet when the web discharge gap is in its first location and a calender roll pair which is underneath the trumpet outlet when the web discharge gap is in its second location.

By virtue of the fact that in the starting phase the non-utilizable, discontinuous web is advanced with a uniform speed, its further transportation and removal without interruption is possible. In contrast to known processes, the complicated, rpm-controlled tapering of a pre-sliver is dispensed with; such a tapering is not even possible because of the throughgoing fiber flow. By virtue of a further inventive measure, according to which, after the thread-in phase (second step) the sliver is formed by gathering or mechanical narrowing of the useful fiber web, advantageously the tapering operation is simultaneously introduced: while a wide fiber web enters into the gathering trumpet, a compressed, narrow sliver is discharged thereby. It is a further advantage of the invention that the sliver is severed by a clamping device in the trumpet, whereby a tapered end of the fiber sliver is obtained without the need of a complex pneumatic device which the prior art has utilized for the sliver formation and for emulating the manual tapering of the sliver terminus. Further, the leading end of the sliver exiting from the clamping trumpet is introduced along a predetermined path into the calender rolls and grasped thereby. Thus, the process according to the invention permits an advantageous automatic startup in an operationally safe and disturbance-free manner.

The non-utilizable fiber web discharged by the delivery device is expediently removed by suction.

BRIEF DESCRIPTION OF THE DRAWING

FIG. 1 is a schematic elevational view of the carding machine incorporating the invention.

FIG. 1*a* is an enlarged schematic top plan view of details of the structure shown in FIG. 1.

FIGS. 4*a* and 4*b* are schematic perspective views of parts of still another embodiment of the invention.

DESCRIPTION OF THE PREFERRED EMBODIMENTS

Figure 2A:
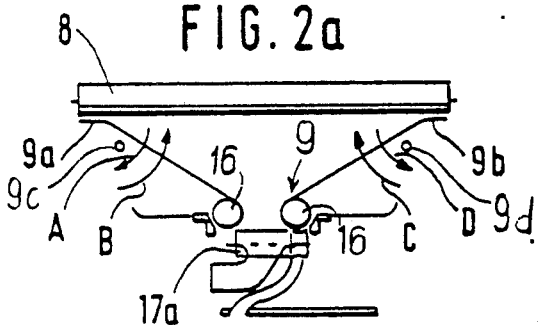
FIGS. 2*a*–2*f* are schematic elevational views of an embodiment of the invention shown in different operational positions.

Turning to FIG. 1, there is shown therein a carding machine CM which may be an EXACTACARD DK model manufactured by Trützschler GmbH & Co. KG, Mönchengladbach, Federal Republic of Germany. The carding machine has a feed roll 1, a feed table 2, a licker-in 3, a main carding cylinder 4, a doffer 5, a stripping roll 6, crushing rolls 7, 8, a web guiding element 9, a sliver trumpet 10, calender rolls 11, a sliver-guiding tube 12, a sliver coiler 13, a coiler can 14 as well as travelling flats 15. The curved arrows drawn into the various rolls indicate directions of rotation. The web guiding element 9 which serves as a web advancing device for gathering and transporting the fiber web discharged by the crushing rolls 7, 8 is situated substantially vertically below the crushing roll 7, 8. The web guiding element 9 is adjoined by a pair of cooperating rolls 16.

Turning now to FIGS. 1*a* and 2*a*–2*f*, underneath the web guiding element 9 which is made of two movable parts 9*a* and 9*b*, there is situated a pair of delivery rolls 17. The web guiding element 9*a*, 9*b* and the rolls 16 are arranged vertically below the crushing rolls 7, 8. Further, vertically below the web guiding element 9*a*, 9*b* and the rolls 16 there are arranged the delivery rolls 17 and the calender rolls 11 in a horizontally adjoining, axially aligned relationship. The output side of the delivery rolls 17 is adjoined by a suction pipe 18 connected to a non-illustrated suction source. Between the web guiding element 9 and the delivery rolls 17 and the calender rolls 11 a gathering trumpet 10 is arranged which, as a unit, is shiftable in a horizontal direction and which is formed of two parts that are movable relative to one another in a horizontal direction.

In the description which follows, the operation shown in FIGS. 2*a*–2*f* will be set forth. In the starting phase (run-up phase) of the carding machine only fragmented, non-coherent web portions are produced which are not adapted to form a continuous fiber sliver. The web parts are, as shown in FIG. 2*a*, gathered by the web guiding element 9 whose guide faces 9*a* and 9*b* form a downwardly open triangle. The rolls 16 which are situated at the end of the respective guide face 9*a*, 9*b* grasp the fragmented web portions and advance them to the delivery rolls 17. The fiber web portions discharged by the delivery rolls 17 enter the suction tube 18 and are thus removed.

Figure 2B:
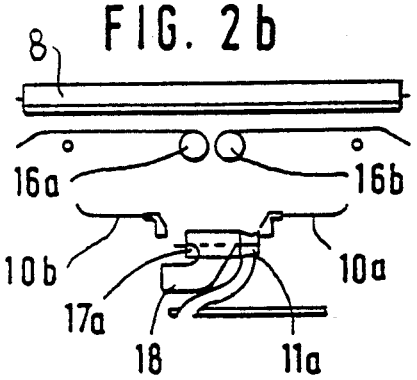
Figure 2C:
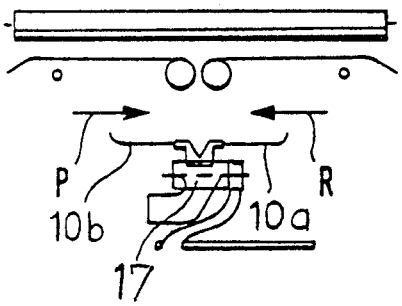

After a period of about 10–15 seconds the run-up phase of the carding machine is terminated, whereupon the guide faces 9*a*, 9*b* are pivoted about pivots 9*c*, 9*d* together with the respective rolls 16 upwardly in the direction of the arrow B towards the crushing rolls 7, 8 to assume their position as illustrated in FIG. 2*b*. Thereafter, the two halves 10*a*, 10*b* of the gathering trumpet 10 are moved towards one another as shown in FIG. 2*c* to thus surround the fiber web 19 as shown in FIG. 7*b*, as a result of which the constricted passage of the closed gathering trumpet 10 forms a fiber sliver 20 from the web 19.

Figure 2D:
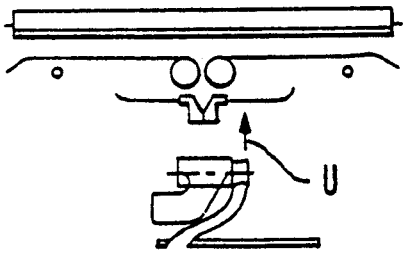
Figure 7A:
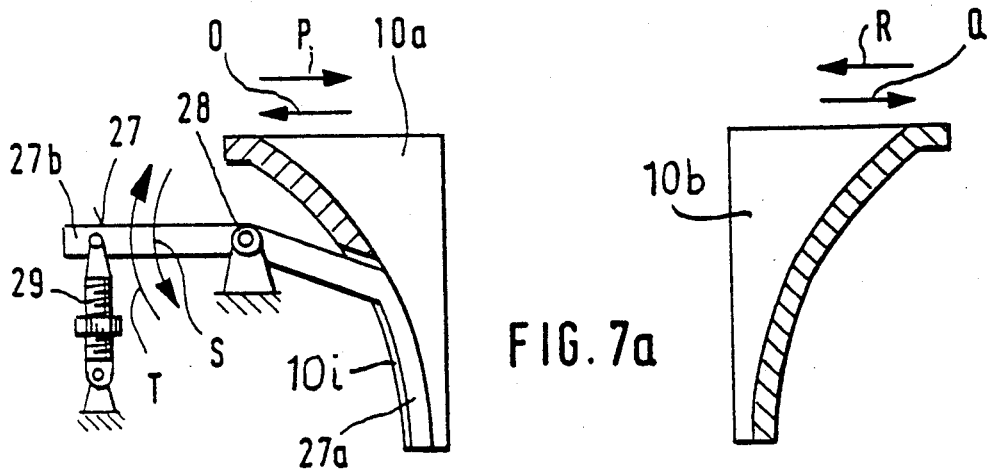
FIGS. 7*a* and 7*b* are schematic elevational views of a two-piece gathering trumpet forming part of the invention.
Figure 7B:
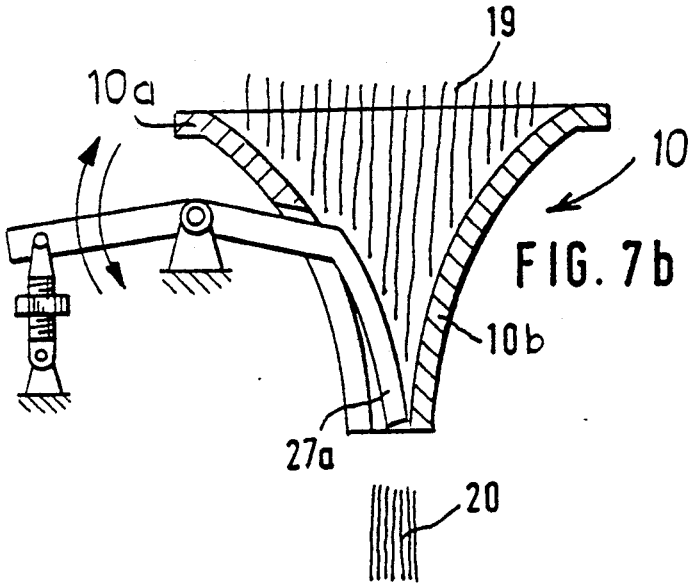

As shown in FIG. 2*d*, the gathering trumpet 10 is thereafter raised in the direction of the arrow U and the fiber sliver 20 is, as shown in FIG. 7*b*, severed as the sliver is clamped at the downstream end of the gathering trumpet 10 and continues to be pulled by the delivery rolls 17.

Figure 2E:
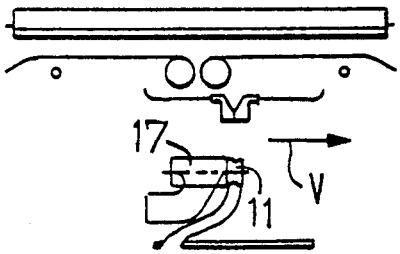
Figure 2F:
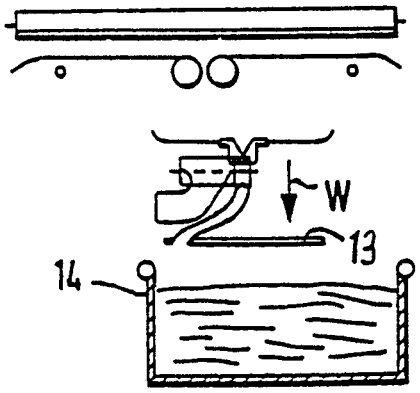

As shown in FIG. 2*e*, in a subsequent step the gathering trumpet 10 is moved horizontally in the direction of the arrow V into alignment with the calender rolls 11, the clamping device is released and thereafter the end of the gathering trumpet 10 is, as shown in FIG. 2*f*, moved vertically downwardly in the direction of the arrow W into the gap defined by the two calender rolls 11*a*, 11*b*. The calender rolls 11 grasp the terminus of the fiber sliver 10 projecting beyond the gathering trumpet 10 and continuously pull the sliver 20 from the gathering trumpet 10. As the final step, the sliver 20 is deposited into the coiler can 14 by the coiler mechanism 13 which includes the sliver guiding tube 12 through which the sliver passes.

Figure 3A:
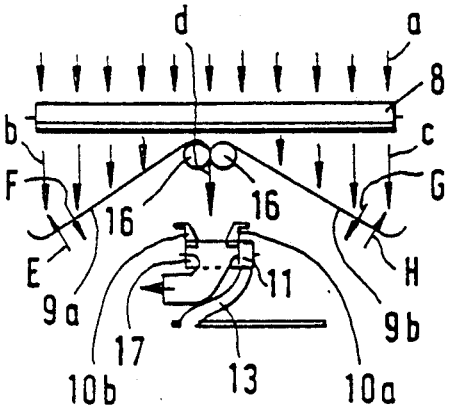
FIGS. 3*a*–3*f* are schematic elevational views of another embodiment of the invention illustrated in different operational positions.
Figure 3B:
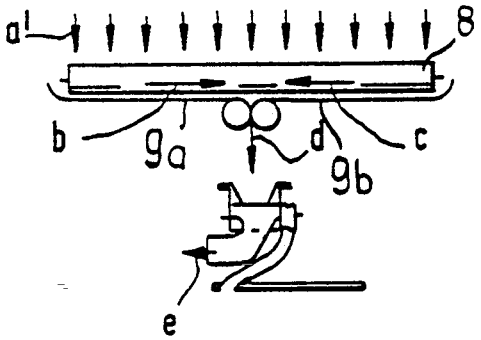
Figure 3C:
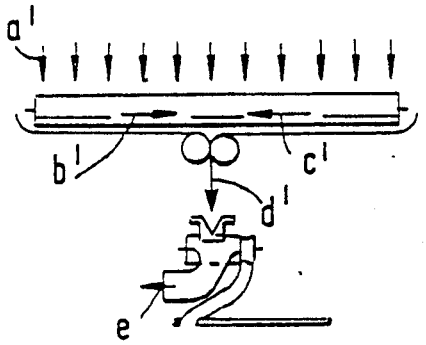
Figure 3D:
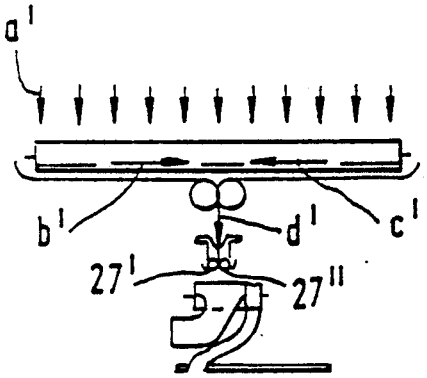

Another embodiment of the invention is illustrated in FIGS. 3a–3f, showing various operational positions. In these Figures the flow of fiber material is also shown, symbolized by arrows. The rolls 16 are non-displaceably supported in the immediate vicinity of the crushing rolls 7, 8. After completion of the startup phase (FIG. 3a) of the carding machine, the web guiding faces 9a, 9b pivot upwardly, substantially about the axis of rolls 16, to assume a position immediately adjacent and parallel to the crushing rolls 7, 8 as shown in FIG. 3b. The guide faces 9a and 9b have an upwardly oriented curved terminus. The mode of operation in the operational positions 3a–3f corresponds to that of the operation of the first-described embodiment, depicted in FIGS. 2a–2f, respectively. The flow of the non-utilizable fiber web 19 which is present in the starting phase is designated at a, b, c, d and e. The flow of the useful fiber web which is present in the thread-in phase subsequent to the startup phase, is designated at a', b', c' and d'. f designates the direction of advance of the fiber sliver 20.

Figure 5A:
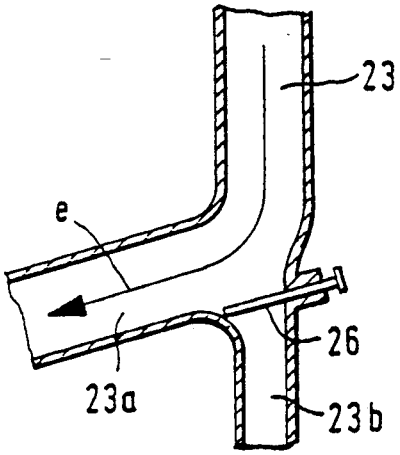
FIGS. 5*a* and 5*b* are schematic elevational views of parts of yet another embodiment.
Figure 5B:
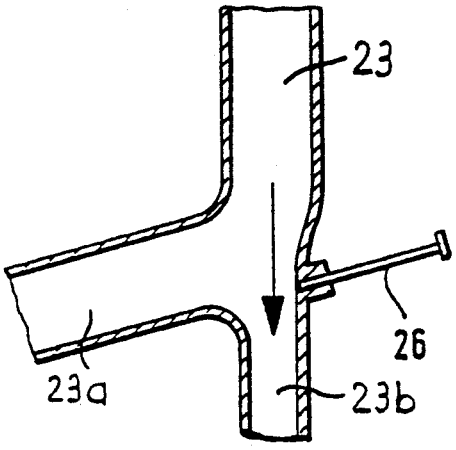

As illustrated in FIG. 4a, underneath the crushing rolls 7, 8 a web guide element having two downwardly converging guide faces (plates) 21a, 21b is provided. The guide faces 21a, 21b define an elongate bottom opening 21c and form a lateral screen. Underneath the bottom opening 21c a receiving trough 22 is provided which is adjoined by a suction tube 23 for the non-utilizable fiber web e. FIG. 4a shows the device in the startup phase. Subsequent to the startup phase the suction device 22, 23 is, in a manner not shown, moved away from under the crushing rolls 7, 8 and the web guide faces 21a, 21b and the bottom opening 21c are closed off from opposite sides by two cover belts 24a, 24b leaving only an opening 25 located centrally relative to the length of the plates 21a, 21b, as shown in FIG. 4b. The useful web exiting the opening 25 is transported downwardly by the cooperating rolls 16 which have been brought together into a cooperating relationship from their position shown in FIG. 4b. Thereafter the fiber web is gathered by the gathering trumpet 10a, 10b (whose halves were closed from the open position shown in FIG. 4b) to thus form a sliver from the web. As shown in FIGS. 5a and 5b, the suction pipe 23 has two outlets 23a and 23b separated from one another by a slidable gate 26 so that, as long as non-utilizable fiber web is supplied, the latter is guided into the outlet 23a. When useful fiber web enters the suction pipe 23 the gate 26 is withdrawn (as shown in FIG. 5b) so that the useful fiber web may exit through the outlet 23b.

Figure 6:
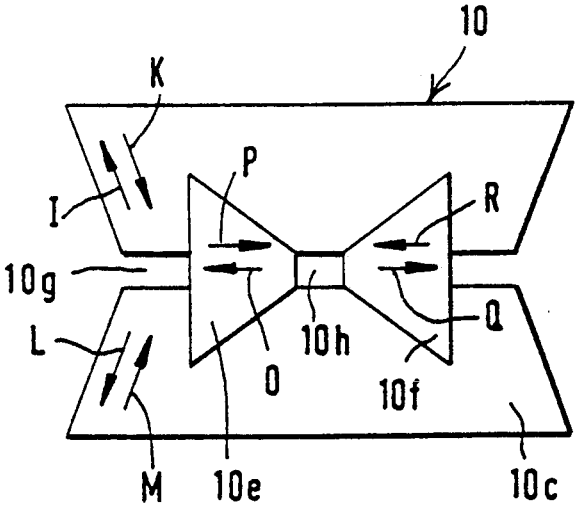
FIG. 6 is a schematic top plan view of a gathering trumpet forming part of the invention.

Turning now to FIG. 6, the gathering trumpet 10 schematically shown therein in a rear end view, as seen in the direction of sliver advance, has four obliquely arranged side walls 10c, 10d, 10e and 10f. The side walls 10c and 10d which together define an open downstream clearance 10g, are displaceable in the direction of arrows I, K and, respectively, L, M whereby the width of the clearance 10g may be adjusted. The side walls 10e and 10f are displaceable as indicated by the arrows 0, P and, respectively, Q, R whereby the width and thus the area of the flow passage 10h of the gathering trumpet 10 may be changed. The motion of the lateral faces 10c and 10f corresponds to the motion of the halves 10a, 10b of the gathering trumpet 10 shown in FIGS. 2b, 2c and, respectively, 3b, 3c.

Turning to FIG. 7a, a clamping device, including a two-armed lever 27 is associated with the half 10a of the gathering trumpet 10. The two-armed lever 27 is swingable about a pivot 28. The lever arm 27a of the two-armed lever 27 projects through a slot 10i provided in the trumpet half 10a, while the arm 27b of the two-armed lever 27 is connected with a pneumatic cylinder 29. The lever 27 is rotatable as indicated by the arrows S and T. FIG. 7b depicts an operational position in which the two trumpet halves 10a and 10b have been brought together and further, the lever 27 has been actuated by the pneumatic cylinder 29 so that the free end portion of the arm 27a which constitutes the clamping element proper, presses the sliver 20 against the opposite inner wall of the trumpet half 10b (which corresponds to the operational step illustrated in FIGS. 2d, 3d). By virtue of the continuing rotation of the delivery rolls 17 a tension is generated so that the fiber sliver 20 breaks off at the clamping location.

Figure 3E:
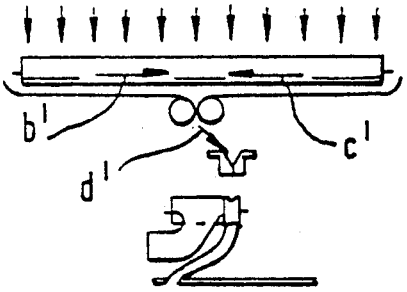
Figure 3F:
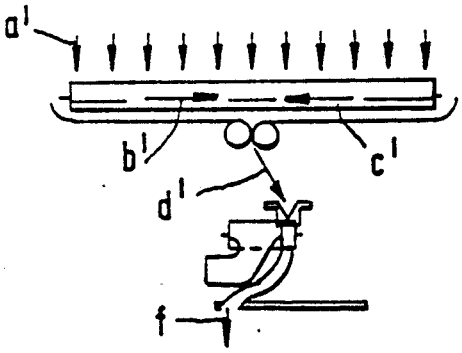
Figure 8:
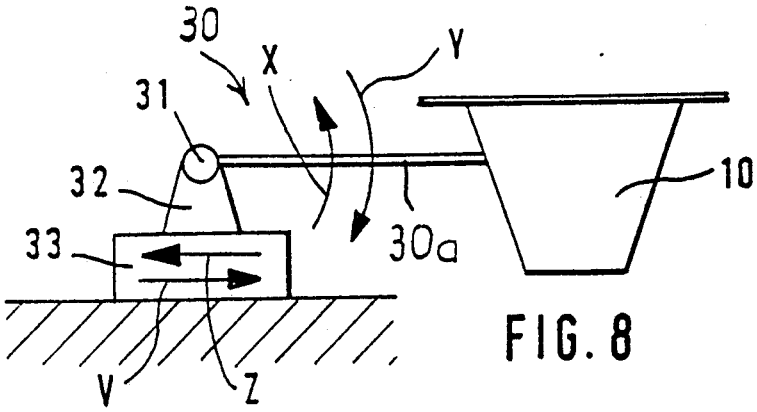
FIG. 8 is a schematic side elevational view of a holding device for a horizontally shiftable trumpet.

Turning to FIG. 8, there is illustrated therein a trumpet holder 30 including a lever 30a, one end of which carries the gathering trumpet 10 while its other end is held in a rotary bearing 31. By rotating the lever 30a in the direction of the arrows X or Y the gathering trumpet 10 is swung upwardly or downwardly in accordance with the steps depicted in FIGS. 3c, 3d. The bearing 31 is secured by a bracket 32 to a slide 33 which is linearly displaceable as indicated by the arrows V, Z whereby the gathering trumpet 10 may horizontally change its location as depicted in FIGS. 2e and 3e.

Figure 9A:
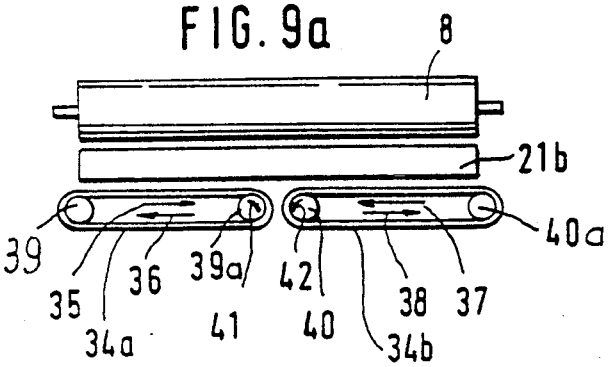
FIGS. 9*a*, 10*a* and 10*c* are schematic side elevational views
Figure 9B:
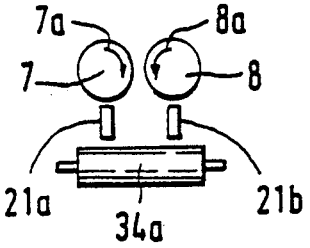
FIGS. 9*b*, 10*b* and 10*d* are schematic end elevational views of another embodiment of the invention, depicted in different operational positions.

Turning to FIGS. 9a and 9b, underneath the crushing rolls 7 and 8 which are rotated in the direction of arrows 7a and 8a, there are provided two endless conveyor belts 34a, 34b which constitute a web gathering and transporting device and which are supported by end rollers 39, 39a and 40, 40a, respectively. The horizontal working surfaces of the two belts are movable in the direction of the arrows 35, 36, 37 and 38. The supporting end rolls 39a and 40 rotate in the direction of the arrows 41, 42, respectively. Between the crushing rolls 7, 8 and the conveyor belts 34a, 34b downwardly oriented air screening elements 21a, 21b are provided. The conveyor belts 34a and 34b are in the same position in the threading operation (startup phase) as in the normal operation (production phase).

Figure 10A:
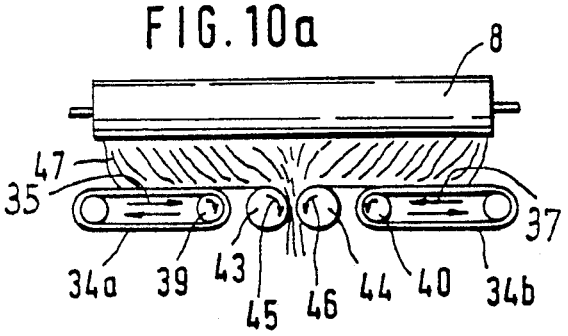
Figure 10B:
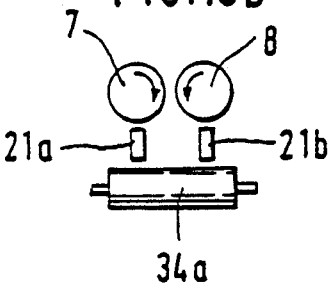
Figure 10C:
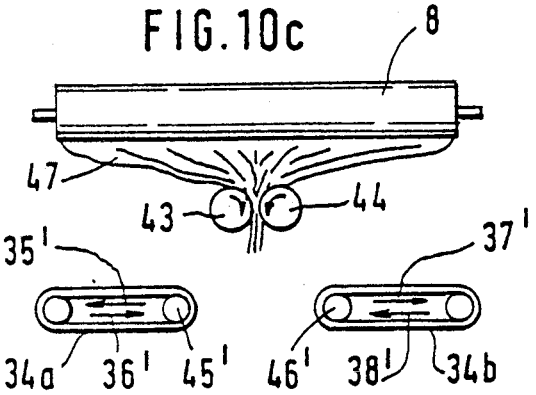
Figure 10D:
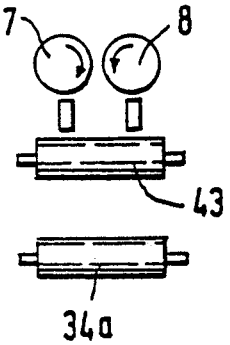

Turning now to FIGS. 10a and 10b, between the adjoining end rollers 39 and 40 of the conveyor belts 34a, 34b axially parallel web transporting rolls 43 and 44 are provided which rotate in the direction as indicated by the arrows 45 and 46. In the starting phase, according to FIGS. 10a and 10b, the conveyor belts 34a, 34b and the rolls 43, 44 are situated horizontally in a single plane. The fiber web emerges with a relatively low speed from between the crushing rolls 7, 8, impinges from above on the upper faces of the conveyor belts 34a, 34b and is thereafter conveyed in the direction of the arrows 35 and 37 and then exits through the gap defined between the rolls 33 and 34. In the consecutive operational phase as depicted in FIGS. 10c, 10d the rapidly moving fiber web 47 has an approximately triangular shape and is admitted from the crushing rolls 7, 8 directly into the gap defined by the rolls 43, 44 without contacting the conveyor belts 34a, 34b. The conveyor belts 34a, 34b are movable vertically downwardly from their position shown in FIGS. 10a, 10b to the position shown in FIGS. 10c, 10d. Expediently, the surfaces of the conveyor belts 34a, 34b are movable in the direction of the arrows 35'–38', that is, the direction of motion is reversed compared to FIG. 10*a* and is directed outwardly so that the impurities dropping from the fiber web 47 such as trash, leaf or stem fragments and the like may be outwardly removed on the conveyor belts 34*a*, 34*b*.

Figure 11A:
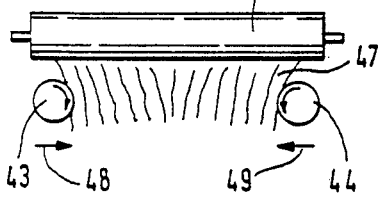
FIGS. 11*a*, 11*b*, 12*a*, 12*b*, 13*a*, 13*b*, 14*a*, 14*b* and 15*a*, 15*b* are schematic elevational views of five further embodiments shown in different operational positions.
Figure 11B:
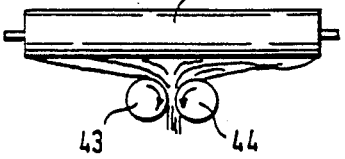

FIGS. 11*a*, 11*b* illustrate an embodiment wherein the rolls 43, 44 are moved away from one another for the threading operation (FIG. 11*a*). In the normal operational phase, as depicted in FIG. 11*b*, the rolls 43, 44 have been brought together by a non-illustrated supporting device as shown by arrows 48 and 49 in FIG. 11*a*.

Figure 12A:
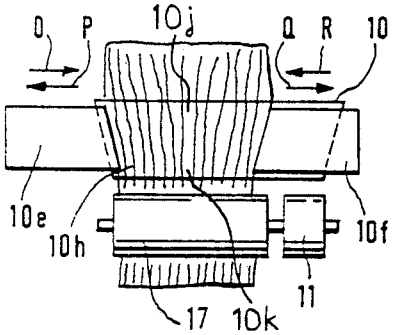
Figure 12B:
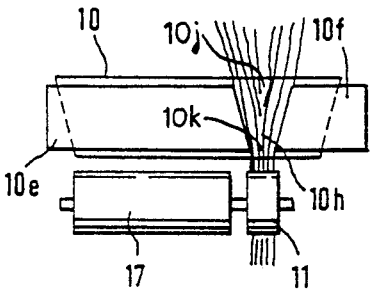

In FIG. 12 the gathering trumpet 10 is arranged stationarily above the delivery rolls 17 and the calender rolls 11. In the starting phase, corresponding to the illustration in FIG. 12*a*, the movable slide elements 10*e*, 10*f* are in a separated and leftward shifted position, so that the non-utilizable fiber material is grasped by the cooperating delivery rolls 17. In the operating phase, as shown in FIG. 12*b*, the slide elements 10*e*, 10*f* are in a close and rightward shifted position so that the useful material (that is, the fiber sliver) is admitted into the gap defined by the calender rolls 11. Thus, in the gathering trumpet shown in FIGS. 12*a*, 12*b* the trumpet inlet 10*j* and the trumpet outlet 10*k* are horizontally shiftable, while the trumpet as a whole does not change its horizontal position.

The invention thus encompasses arrangements in which the sliver terminus emerging from the gathering trumpet 10 is introduced into the calender rolls 11 either by a shift of the entire gathering trumpet 10 or by a local shift of the wall faces within the stationarily arranged gathering trumpet. The stationary gathering trumpet 10 has a flow passage which may be regulated in a manner described in conjunction with FIG. 6.

Figure 13A:
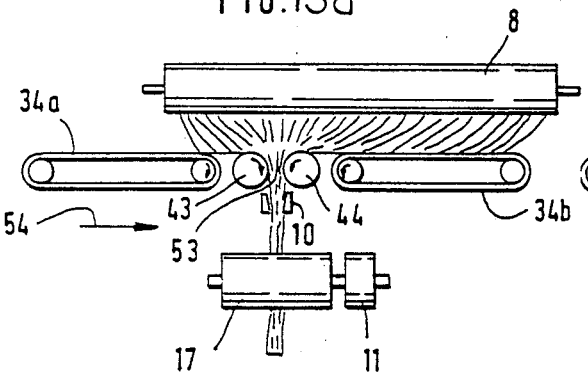

Turning now to the embodiment shown in FIG. 13*a*, in the startup phase the web transporting rolls 43 and 44 and a web discharging gap 53 defined thereby as well as the gathering trumpet 10 are arranged vertically above the delivery roll pair 17, and the trumpet halves of the trumpet 10 are in their separated position. The fiber web discharged by the crushing rolls 7, 8 (only the roll 8 is visible) is guided by the web transporting belts 34*a*, 34*b* towards the rolls 43, 44. For the thread-in phase (production phase) depicted in FIG. 13*b*, the belts 34*a*, 34*b*, the rolls 43, 44 and the gathering trumpet 10 are shifted together in the direction of the arrow 54 so that the rolls 43, 44, with the web discharging gap 53 defined thereby and the gathering trumpet 10 (whose halves are closed to assume a joined position) are arranged vertically above the calender roll pair 11. In this manner, the fiber web (pre-sliver) discharged through the gap 53 defined by the rolls 43, 44 is, in the startup phase as well as in the threading or production phase vertically aligned with the gathering trumpet 10. Thus, because of a smaller deflection, the pull on the material as viewed transversely is more uniform and further, unintended sliver ruptures are prevented.

Figure 13B:
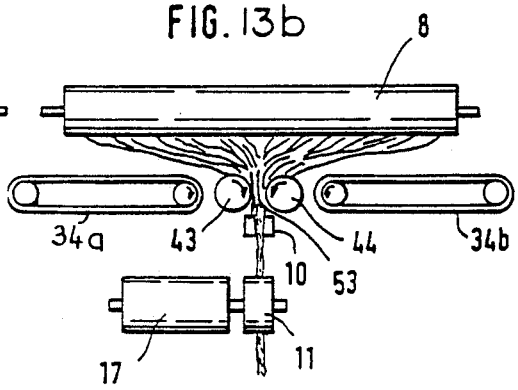
Figure 14A:
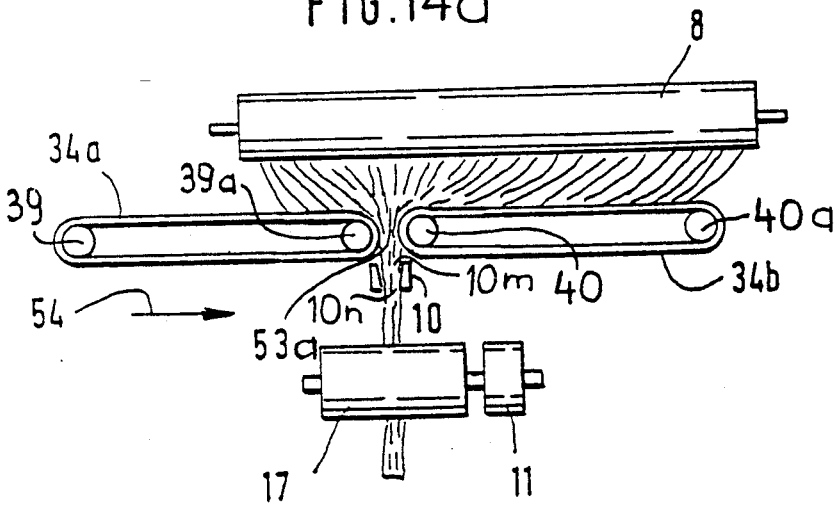
Figure 14B:
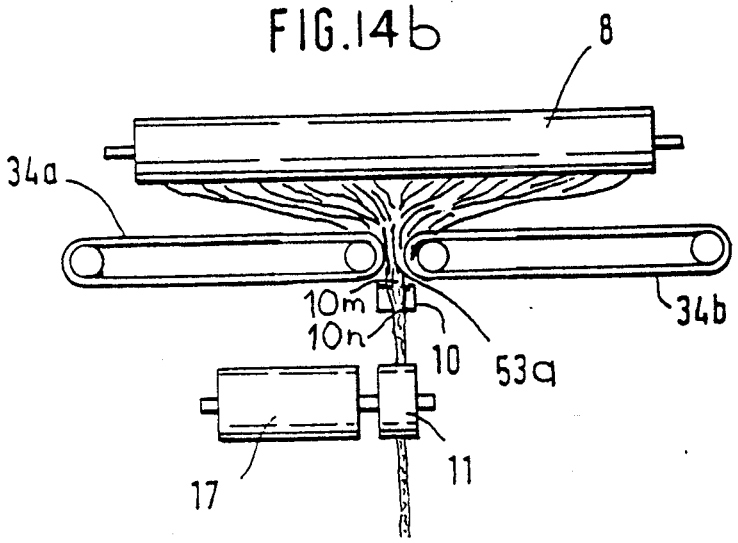

The embodiment illustrated in FIGS. 14*a* and 14*b* is similar to the embodiment shown in FIGS. 13*a*, 13*b*, except that the transporting rolls 43, 44 are omitted altogether.

Thus, as shown in FIG. 14*a*, the fiber web discharging gap 53*a* is defined by the transport belts themselves, similarly to the arrangement shown in FIG. 9*a*. FIG. 14*a* shows the startup phase in which the still non-coherent web is gathered by the transporting belts 34*a* and 34*b* and discharged downwardly through the gap 53*a*, into the trumpet inlet 10*m* situated vertically below the gap 53*a*. The trumpet outlet 10*n* is situated vertically above the delivery rolls 17. Thus, the fiber material travels vertically downwardly from the trumpet 10 and is introduced into the nip of the delivery rolls 17 which guide away the non-coherent (waste) web during the startup phase.

As soon as the web discharged by the crushing rolls 7, 8 is in a useful, coherent state and thus the production phase may start, the belts 34*a*, 34*b* as well as the gathering trumpet 10 are horizontally shifted as a unit to assume their position illustrated in FIG. 14*b*. For this purpose, the belt supporting rolls 39, 39*a*, 40, 40*a* and the trumpet 10 may be supported in a non-illustrated common frame shifted horizontally in the direction of the arrow 54. In the position shown in FIG. 14*b*, the halves of the trumpet 10 are moved toward one another to assume their closed, joined position. The trumpet inlet 10*m* remains in a vertical alignment with the web discharging gap 53*a* and the trumpet outlet 10*n* is now in a vertical alignment with the calender rolls 11. Thus, subsequent to severing the web as described in connection with FIG. 7*b*, the coherent fiber web, gathered into a sliver by the trumpet 10 is threaded into the nip of the calender rolls 11 and thereafter the sliver is deposited in a normal sliver coiling operation as described in connection with FIG. 1.

It will be understood that, as an alternative, the trumpet may be designed as described in connection with FIGS. 12*a* and 12*b* in which case the trumpet as a whole remains stationary, while the trumpet inlet 10*m* and the trumpet outlet 10*n* shift horizontally to ensure the proper, desired alignments.

Figure 15A:
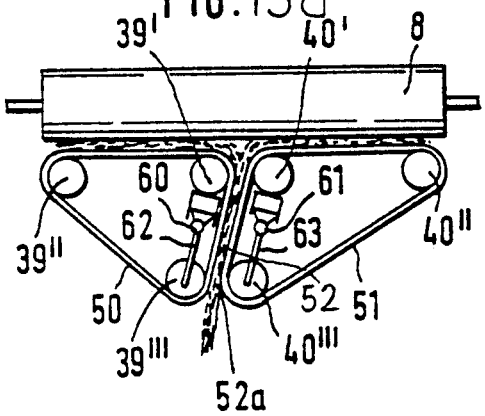
Figure 15B:
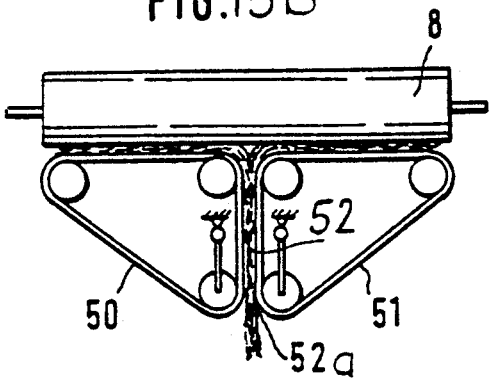

Turning to the embodiment illustrated in FIGS. 15*a* and 15*b*, there are provided two web transporting endless belts 50 and 51, supported by rollers 39', 39'', 39''' and 40', 40'' and 40''', respectively. The two belts are of triangular course and have adjoining, parallel running flights which define a web transporting passage 52 terminating in a discharge gap 52*a*. The support roller 39''' for the belt 50 and the support roller 40''' for the belt 51 are supported by respective pivotal arms 62 and 63, articulated at 60, 61, respectively. The position of the web discharging gap 52*a* as depicted in FIG. 15*a* corresponds to the position of the gap 53*a* in FIG. 14*a* and thus delivers non-coherent web material during the startup phase to the trumpet and the delivery rolls, not shown in FIG. 15*a*.

By imparting simultaneously an appropriate force on the pivotal arms 62 and 63, the rollers 39''' and 40''' swing counterclockwise in an arcuate path as viewed in FIG. 15*a* to assume a position illustrated in FIG. 15*b*. In this position the web discharging gap 52*a* at the end of the web transporting passage 52 assumes a position that corresponds to the position of the gap 53*a* in FIG. 14*b*. Thus, in this position the production phase may take place in which the usable, coherent fiber web is introduced into the trumpet 10 and the calender rolls, not shown in FIG. 15*b*. The nonillustrated coordination between the trumpet, the delivery rolls, the calender rolls and the web discharging gap defined by the transporting belt may be the same as described in connection with the embodiment illustrated in FIGS. 14*a* and 14*b*.

Figure 16:
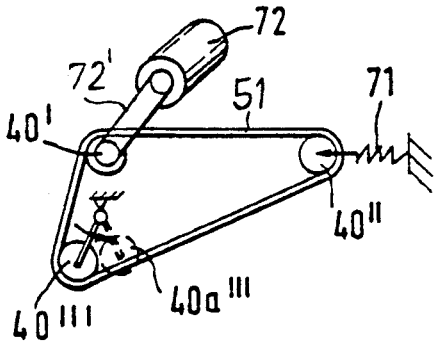
FIGS. 16 and 17 are schematic elevational views of modifications of the embodiment shown in FIGS. 15*a*, 15*b*.

Turning to FIG. 16, the support roller 40'' of the belt 51 is held with the intermediary of a biasing spring 71. The support roller 40' is driven from a motor 72 by means of a drive belt 72'. The same arrangements are provided for the support rollers 39'' and 39' associated with the web transporting belt 50.

Figure 17:
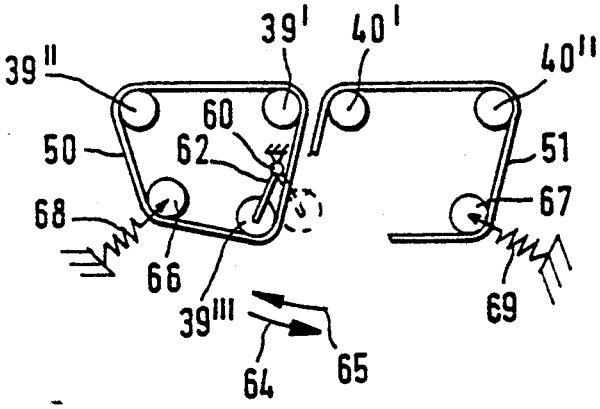

The embodiment illustrated in FIG. 17 differs from that shown in FIGS. 15*a* and 15*b* in that for each transport belt 50, 51, respective tensioning rollers 66, 67 are provided which are biased outwardly by respective springs 68, 69 for resiliently tensioning the respective belts 50, 51. Upon pivoting the roller 39''' (and the non-illustrated roller which supports the belt 51 and which corresponds to the support roller 40''' shown in FIG. 15*a*) from its solid-line position into the phantom-line position which causes the horizontal, arcuate shift of the web discharging gap into a position that corresponds to the position shown in FIG. 15*b*, the biasing springs 68 and 69 ensure that the proper tensioning of the belts 50 and 51 is maintained. Expediently, the pivotal supports 60, 61 are situated in the zone between the supporting rollers 39', 39''' for an advantageous spatial arrangement.

In FIGS. 16 and 17, the support rollers 39''' and 40''' serve only as deflecting rollers for the respective fiber web transporting belts 50 and 51, while the tensioning of the belts 50, 51 is effected by biasing springs 68, 69 and 71.

It will be understood that the above description of the present invention is susceptible to various modifications, changes and adaptations, and the same are intended to be comprehended within the meaning and range of equivalents of the appended claims.

What is claimed is:

1. An automatic startup device for a continuous formation of a sliver from a carded fiber web, comprising (a) a roll assembly having an outlet for discharging the fiber web;

(b) a web transporting means for gathering and advancing the web discharged by said roll assembly; said web transporting means being situated under said roll assembly; said web transporting assembly comprising (1) two endless conveyor belts defining, between themselves, a web discharging gap oriented such that the web exits the gap in a downward direction; said endless conveyor belts having a first position in which said gap assumes a first location; said endless conveyor belts having a second position in which said gap assumes a second location being generally horizontally spaced from the first location; and (2) support rollers for supporting each said endless conveyor belt;

(c) a trumpet including means for defining a trumpet inlet and a trumpet outlet; the trumpet inlet being situated substantially vertically below said discharging gap in the first and second locations thereof for receiving the web from the web discharging gap; said trumpet having two separable parts between which the web is introduced; said separable parts each having an inner wall portion forming part of a passage for the web; said separable parts being arranged to assume a separated and a joined position; in said separated position the two trumpet parts are at a relatively large distance from one another, whereby the web is discharged by the trumpet in a substantially unaltered state; in said joined position the two trumpet parts are at a relatively small distance from one another, whereby the web is compressed and discharged by the trumpet as a sliver;

(d) a web delivery means for receiving the web from the trumpet outlet for removing the web; the trumpet outlet being situated substantially vertically above said web delivery means when said web discharging gap of said web transporting means is in said first location; and (e) a calender roll pair receiving and advancing the sliver discharged by said trumpet outlet; the trumpet outlet being situated substantially vertically above said calender roll pair when said web discharging gap of said web transporting means is in said second location.

2. An automatic startup device as defined in claim 1, wherein said trumpet has, as a whole, first and second positions horizontally spaced from one another; in said first position of said trumpet, said trumpet inlet is substantially vertically below said web discharging gap in said first location thereof, and said trumpet outlet is substantially vertically above said web delivery means; and in said second position of said trumpet, said trumpet inlet is substantially vertically below said web discharging gap in said second location thereof, and said trumpet outlet is substantially vertically above said calender roll pair.

3. An automatic startup device as defined in claim 1, further comprising driving means for driving said conveyor belts.

4. An automatic startup device as defined in claim 1, wherein at least one of the support rollers supporting a first of said conveyor belts and at least one of the support rollers supporting a second of said conveyor belts is spring-biased for resiliently tensioning said first and second conveyor belts.

5. An automatic startup device as defined in claim 1, wherein in said first position said conveyor belts and said support rollers are, as a unitary assembly, in a horizontally shifted relationship relative to said second position thereof.

6. An automatic startup device as defined in claim 5, wherein the number of said support rollers is four and further wherein each conveyor belt is trained about two separate said support rollers.

7. An automatic startup device as defined in claim 1, wherein a first of said two conveyor belts is trained about a first, second and third of said support rollers and a second of said two conveyor belts is trained about a fourth, fifth and sixth of said support rollers; the first and the fourth support rollers being situated side-by-side and defining, together with portions of said first and second conveyor belts, said web discharging gap; further comprising means for displacing solely said first and fourth support rollers in a generally horizontal direction for selectively placing said first and second conveyor belts into said first or second position thereof.

8. An automatic startup device as defined in claim 7, wherein said means for displacing said first and fourth support rollers comprise means for shifting said first and fourth support rollers in an arcuate path.

9. An automatic startup device as defined in claim 7, wherein said second and fifth rollers are spring-biased for resiliently tensioning said first and second conveyor belts.

* * * * *